US006117568A

United States Patent [19]

Hashimoto et al.

[11] Patent Number: 6,117,568

[45] Date of Patent: Sep. 12, 2000

[54] CYANOCHROMIUM-COMPLEX-BASED MAGNETIC MATERIAL

[75] Inventors: Kazuhito Hashimoto; Akira Fujishima; Osamu Sato; Tomokazu Iyoda, all of Kanagawa, Japan

[73] Assignee: Kanagawa Academy of Science and Technology, Kanagawa, Japan

[21] Appl. No.: 08/913,167

[22] PCT Filed: Mar. 8, 1996

[86] PCT No.: PCT/JP96/00577

§ 371 Date: Oct. 30, 1997

§ 102(e) Date: Oct. 30, 1997

[87] PCT Pub. No.: WO96/28831

PCT Pub. Date: Sep. 19, 1996

[30] Foreign Application Priority Data

Mar. 10, 1995 [JP] Japan ..... 7-051233

[51] Int. Cl.[7] ..... H01F 10/08

[52] U.S. Cl. ..... 428/692; 205/316; 205/319; 205/479; 205/483

[58] Field of Search ..... 205/316, 319, 205/479, 483; 428/692, 900

[56] References Cited

PUBLICATIONS

Sato et al., "Electrochemically Tunable Magnetic Phase Transition in a High–$T_c$ Chrominum Cyanide Thin Film", Science, vol. 271, pp. 49–51, Jan. 5, 1996.

Sato et al., "Electrochemical Syntheses and Electrochromic Properties of Chromium Cyanide Magnetic Thin Films", Chemistry Letters, pp. 37–38, 1997.

Itaya et al "Electrochemistry of Polynuclear Transistion Metal Cyanides: Prussian Blue and Its Analogs" Acc. Chem. Res. 1986, 19, 162–168.

Mallah et al "High–$T_c$ Molecular Based Magnets: Ferrimagnetic Mixed–Valence Chromium(III)–Chromium(II) Cyanides with $T_c$ at 240 and 190 Kelvin" Science vol. 262 Dec. 3, 1993, 1554–1557.

*Primary Examiner*—Stevan A. Resan

*Attorney, Agent, or Firm*—Wenderoth, Lind & Ponack, L.L.P.

[57] ABSTRACT

The invention provides a novel cyanochromium-complex-based magnetic material formed on an electrode, which is excellent in magnetic properties and of which magnetic properties are reversibly controllable, by impressing a reduction potential which electrochemically reduces $Cr^{3+}$ into $Cr^{2+}$ in a solution containing at least $[Cr(CN)_6]^{3-}$ and $Cr^{3+}$.

11 Claims, 12 Drawing Sheets

CYANOCHROMIUM-COMPLEX-BASED MAGNETIC MATERIAL

BACKGROUND OF THE INVENTION

1. Technical Field

The present invention relates to a cyanochromium-complex-based magnetic material and a manufacturing method thereof. More particularly, the present invention relates to a cyanochromium-complex-based molecular magnetic material having excellent magnetic properties including a high magnetic transition temperature and permitting electrochemical control of magnetic properties thereof, and a manufacturing method thereof.

2. Background Art

The general attention has recently been attracted by molecular magnetic materials having fundamental skeletons of organic radicals, charge-transfer complex and metal complex, quite different from conventionally known magnetic materials.

In spite of expectation of future progress, study on these molecular magnetic materials has just been started, and almost no efforts of scientific research or technological approach have so far been made on improvement of magnetic properties and control thereof as well as manufacturing methods of such materials.

The present invention was developed in view of these circumstances as described above and has an object to provide a novel molecular magnetic material, expected to have ample potentialities in the future, excellent in magnetic properties, which permits control of these properties, and a manufacturing method thereof.

SUMMARY OF THE INVENTION

As means for solving the foregoing problems, the present invention provides a cyanochromium-complex-based magnetic material formed on an electrode as a thin film through electrochemical reduction of $Cr^{3+}$ into $Cr^{2+}$ in a solution in which $[Cr(CN)_6]^{3-}$ and $Cr^{3+}$ are present.

The invention further provides a cyanochromium-complex-based magnetic material of which magnetic properties are variable reversibly through electrochemical oxidation and reduction.

The invention further provides a manufacturing method of a cyanochromium-complex-based magnetic material formed on an electrode as a thin film through electrochemical reduction of $Cr^{3+}$ into $Cr^{2+}$ in a solution in which $[Cr(CN)_6]^{3-}$ and $Cr^{3+}$ are present.

With regard to the manufacturing method, the invention provides embodiments in which magnetic properties are controlled in various manners by altering the electrolytic conditions such as the reduction potential, concentration of the electrolyte, setting of a constant potential and a constant current, quantity of electricity and coexistent ions. For example, in an embodiment, the foregoing solution contains one or more kinds of ions selected from the group of alkali metal ion, alkali earth metal ion, rare earth metal ion and ammonium ion.

DETAILED DESCRIPTION OF THE INVENTION

The cyanochromium-complex-based magnetic material of the invention, having the construction as described above, has excellent magnetic properties including a high magnetic transition temperature, and presents an epoch-making controllability of these properties in a reversibly variable manner. This opens up a wide range of applications such as a recording medium provided with novel functions.

Figure 1:
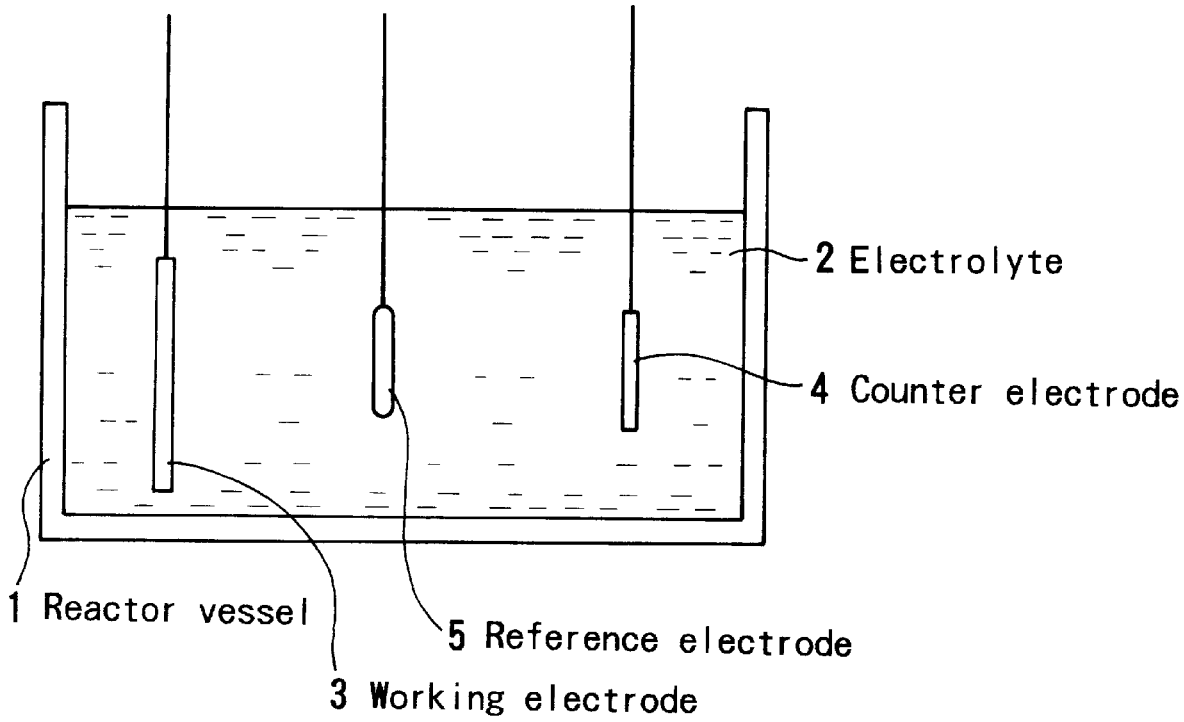
FIG. 1 is a descriptive view of the cyanochromium-complex-based magnetic material of the invention.

The present invention will be described below in further detail with reference to the drawings. FIG. 1 is a descriptive view illustrating the manufacturing method of the cyanochromium-complex-based magnetic material of the invention.

In FIG. 1, an electrolyte 2 is contained in a reactor 1, and a working electrode 3, a counter electrode 4 and a reference electrode 5 are immersed in this electrolyte 2.

The working electrode 3 is a plate-shaped electrode made of, for example, $SnO_2$. The counter electrode 4 is an electrode made of, for example, Pt. the reference electrode 5 is a saturated calomel electrode for determining a reference potential upon measuring a reduction potential or the like. There is no limitation the material or the shape of these electrodes, and potential setting means not shown such as a potentiometer for setting a prescribed potential for these electrodes is appropriately connected.

In the invention, at least $[Cr(CN)_6]^{3-}$ and $Cr^{3+}$ must be present in the electrolyte 2. This is achieved by using an aqueous solution prepared through addition of $K_3[Cr(CN)_6]$ and $CrCl_3.6H_2O$ to water so as to have a concentration within a range permitting electrolysis (usually from several mpmol/l to several tens of mpmol/l), and a prescribed potential is applied to the working electrode 3. There is thus available the thin-film shaped cyanochromium-complex-based magnetic material of the invention on the surface of the working electrode 3.

In the electrode 2, $[Cr(CN)_6]^{3-}$ ion and $Cr^{3+}$ ion are present as described above. While no complex is formed in this state, reducing action reduces the $Cr^{3+}$ ion into $Cr^{2+}$ ion. As a result, $Cr^{2+}$ and $[Cr(CN)_6]^{3-}$ are conjectured to combine on the surface of the working electrode 3 and to be accumulated while forming a complex. This combination varies with the potential impressed on the working electrode 3, quantity of electricity, presence of coexistent ions and other electrolyte conditions, and thin films with different combination structures are considered to be available by selecting specific conditions such as a particular potential.

Coexistent ions may, for example, be incorporated as interstitial ions in the crystal structure as described later because of the size thereof, or the excessively large size may cause destruction of the three-dimensional network with defects. Depending upon the presence of coexistent ions and the kind and size thereof, therefore thin films of different crystal structures are obtained, and this is estimated to exert an influence on the magnetic properties.

Now, the present invention will be described further it detail by means of examples. It is needless to mention that the invention is not limited in any manner by the following examples.

EXAMPLES

Electrolytic reduction was conducted with the combinations of electrolytes and values of potential impressed on the working electrode as shown in the following table, to form three kinds of thin film samples A, B and C on the working electrode.

| Sample | Electrolyte | Electrode Potential |
|---|---|---|
| A | $K_3Cr(CN)_6$ + $CrCl_3.6H_2O$ (0.008 mol/l) (0.08 mol/l) | - 840 mV |
| B | $K_3Cr(CN)_6$ + $CrCl_3.6H_2O$ (0.04 mol/l) (0.04 mol/l) | - 760 mV |
| C | $K_3Cr(CN)_6$ + $CrCl_3.6H_2O$ + CsCl (0.04 mol/l) (0.04 mol/l) (0.04 mol/l) | - 760 mV |

The resultant thin-film samples were confirmed to have the following compositions through element analysis:

A: $Cr_{2.43}(CN)_6$—6.09 $H_2O$

B: $Cr_{2.12}(CN)_6$—2.8 $H_2O$

C: $Cs_{1.15}Cr_{2.06}(CN)_6$—1.7 $H_2O$

Figure 2:
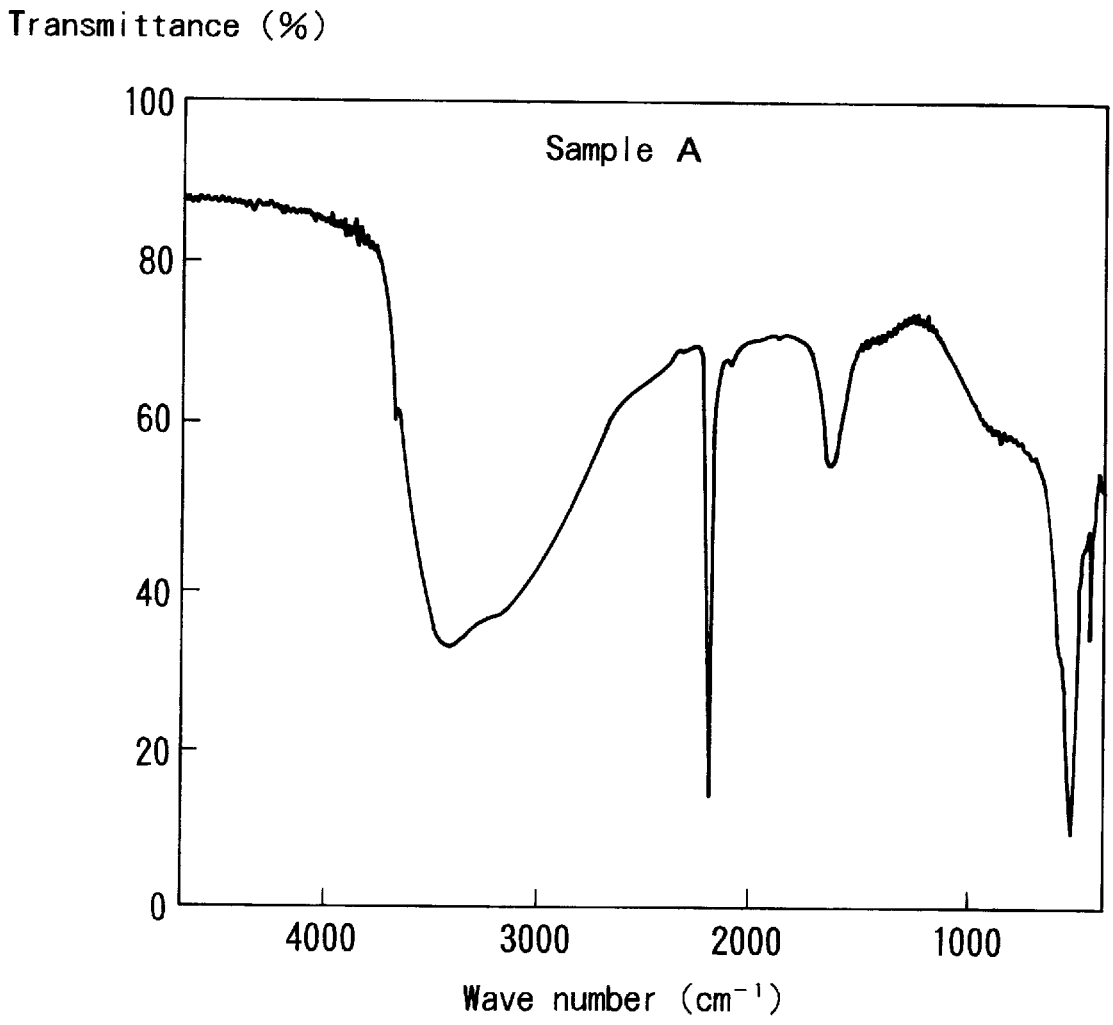
FIG. 2 is a graph illustrating the result of measurement of infrared absorption spectrum of a sample A as an embodiment.
Figure 3:
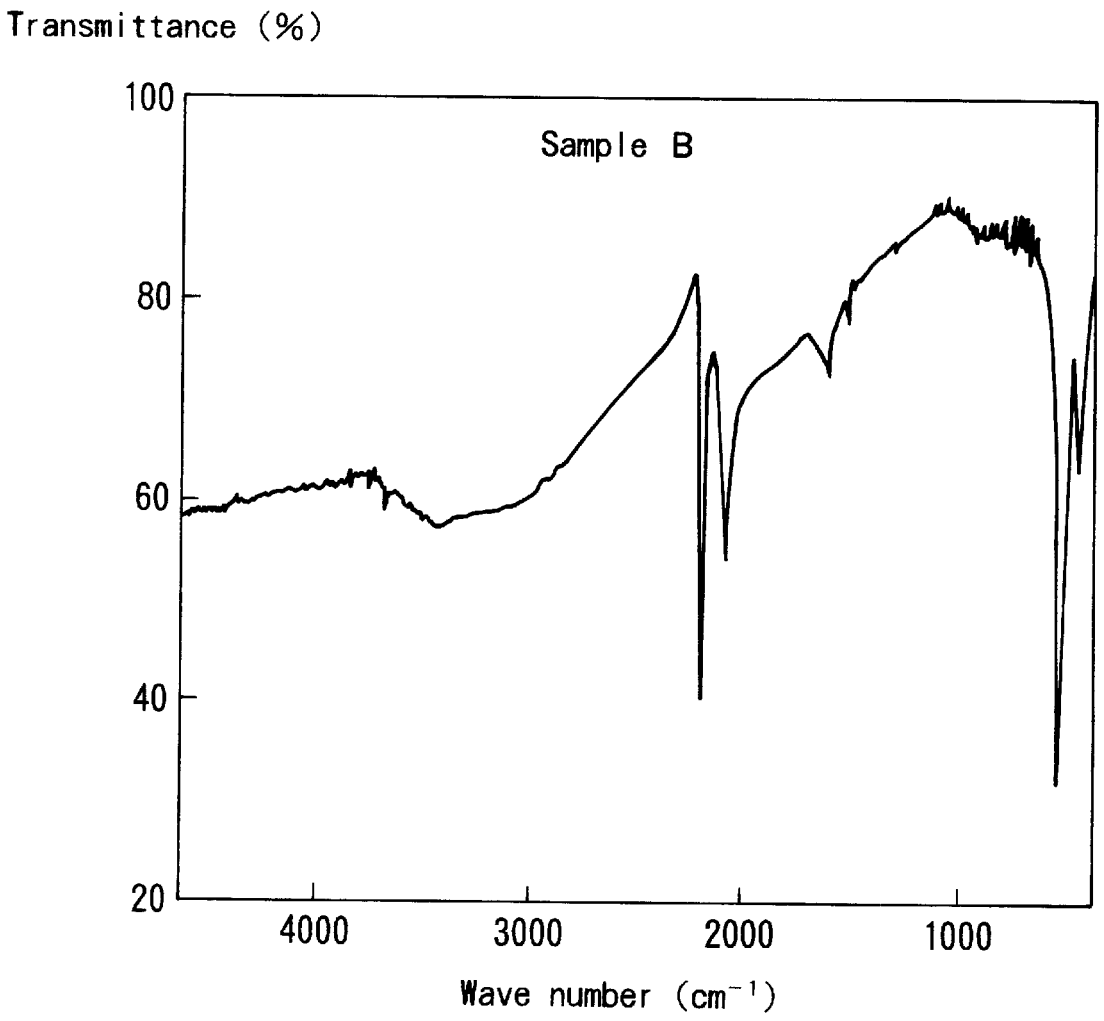
FIG. 3 is a graph illustrating the result of measurement of infrared absorption spectrum of a sample B as an embodiment.
Figure 4:
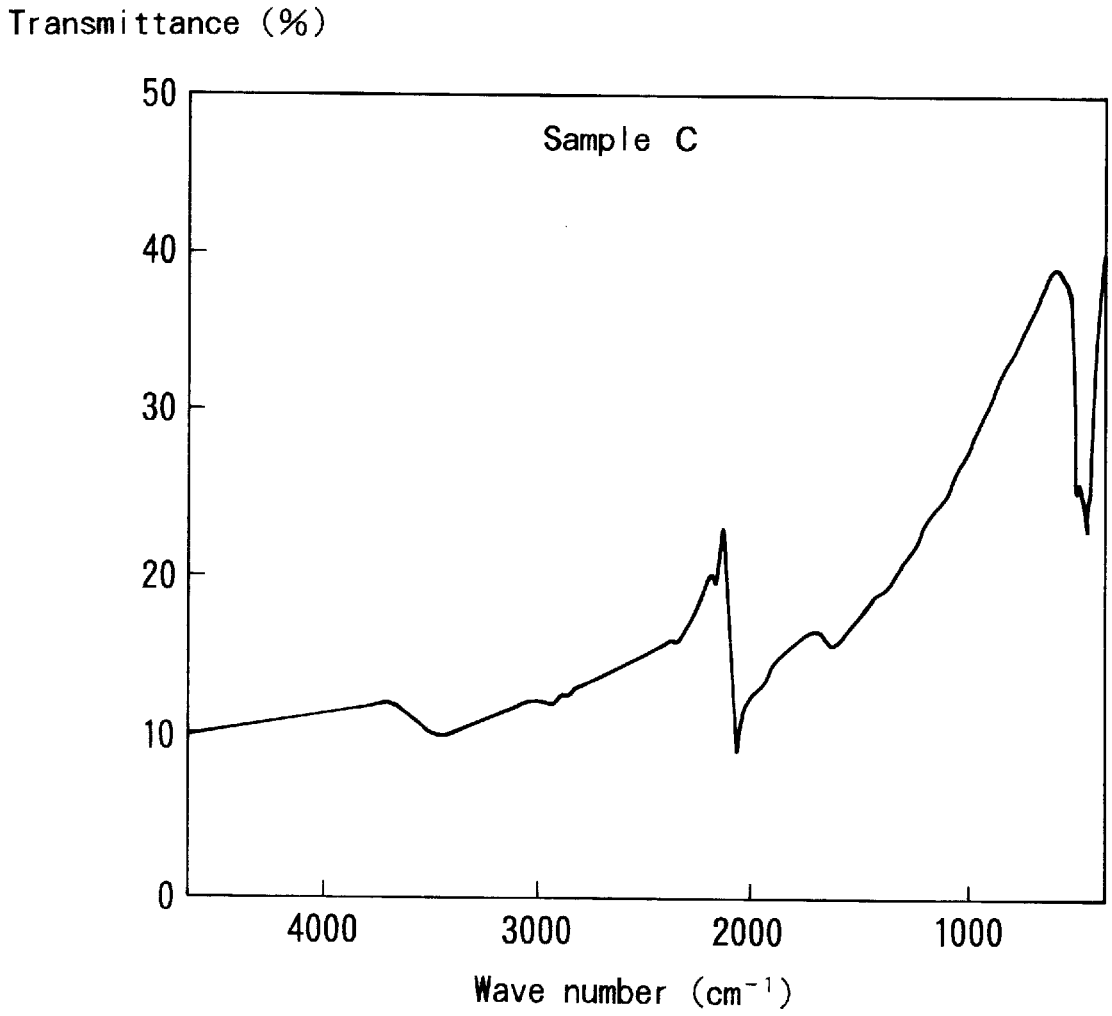
FIG. 4 is a graph illustrating the result of measurement of infrared absorption spectrum of a sample C as an embodiment.

FIGS. 2 to 4 are graphs illustrating the results of measurement of infrared absorption spectra of the thin-film samples A, B and C. In these graphs, the ordinate represents transmittance (unit: %) and the abscissa, wave number (unit: $cm^{-1}$). As is clear from these graphs, the peak of 2,187 $cm^{-1}$ for the sample A and that of 2,186 $cm^{-1}$ for the sample B correspond to the CN stretching vibration having CN structure $Cr^{III}$—CN, and the peak of 2,071 $cm^{-1}$ for the sample B and that of 2,063 $cm^{-1}$ for the sample C correspond to the stretching vibration having a CN structure $Cr^{II}$—CN.

This suggests that the sample A comprises exclusively the $Cr^{III}$—CN structure and the sample C, exclusively $Cr^{II}$—CN stricture, whereas the sample B comprises the both structures. The samples A and C may, therefore, be considered to be in a coupled metamere relationship.

Figure 5:
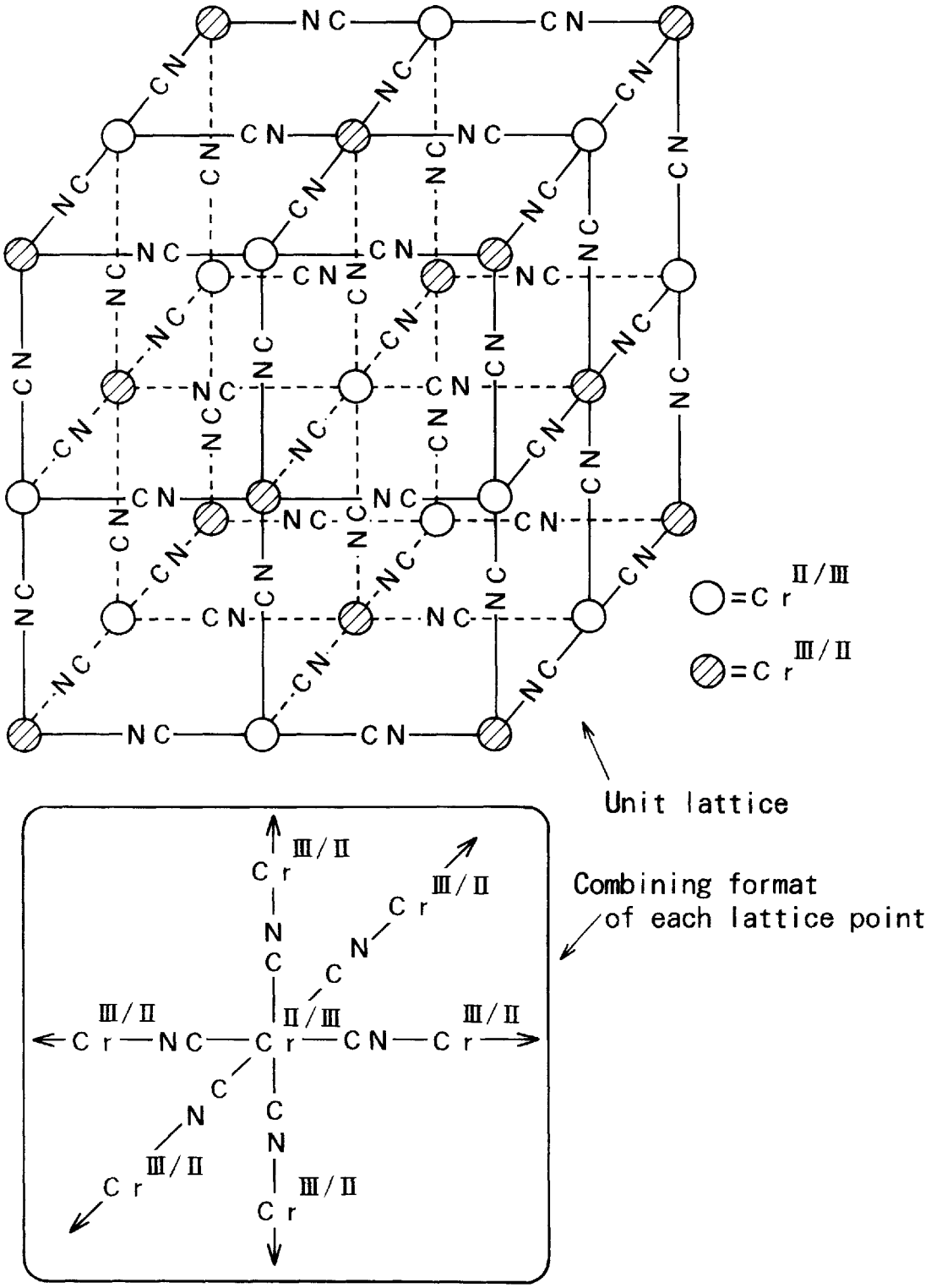
FIG. 5 illustrates a crystal structure model of the foregoing sample A.

FIG. 5 represents a crystal structure model of the sample B. While this diagram shows a perfect structure, it actually contains a partial defect of lacking the $Cr(CN)_6$ unit, and is considered to exhibit respective intrinsic properties, depending upon differences in the amount of defects and in structure.

These results suggest that the structure of the cyanochromium-complex available in a thin film shape on the surface of the working electrode 3 can be freely controlled by controlling potential impressed to the working electrode 3.

Changes in magnetization with temperature were measured for the samples A, B and C by means of a superconducting quantum interferometer (SQUID). For any of the samples, changes in magnetization with temperature within paramagnetism region are in conformity to the Curie-Weiss law, with values of Weiss constant of −320 K, −416 K and −119 K for the samples A, B and C, respectively. The negative values of Weiss constant suggest that spin interaction between the most closely adjacent chromium is antiferrimagnetic.

Figure 6:
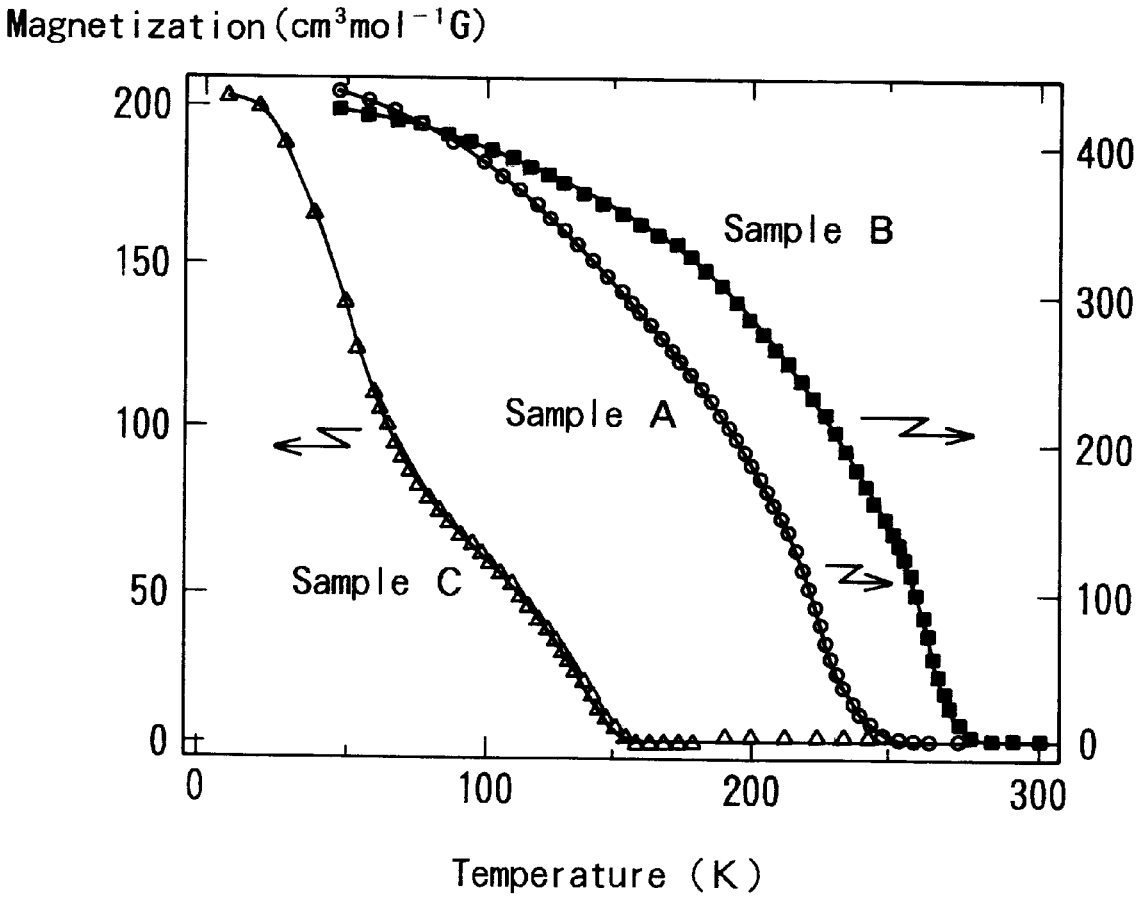
FIG. 6 is a graph illustrating the result of measurement of temperature dependency of magnetization of the foregoing samples A, B and C.

FIG. 6 is a graph illustrating the results of measurement of temperature dependency of magnetization of the Samples A, B, and C. In FIG. 6, the ordinate represents magnetism (unit: $cm^3mol^{-1}G$), and the abscissa, temperature (unit: K), and the measurement was carried out by means of a superconducting quantum interferometer (SQUID) in a magnetic field of 5G.

As is clear from FIG. 6, the samples A, B and C had magnetic transition temperatures of 240 K, 270 K and 150 K, respectively. By combining this result with the result of observation of changes in magnetization relative to temperature as described above, it is suggested that this transition corresponds to the change from paramagnetism into ferrimagnetism. In this case, the transition temperature of 270 K is the maximum among stable molecular magnetic materials.

Figure 7:
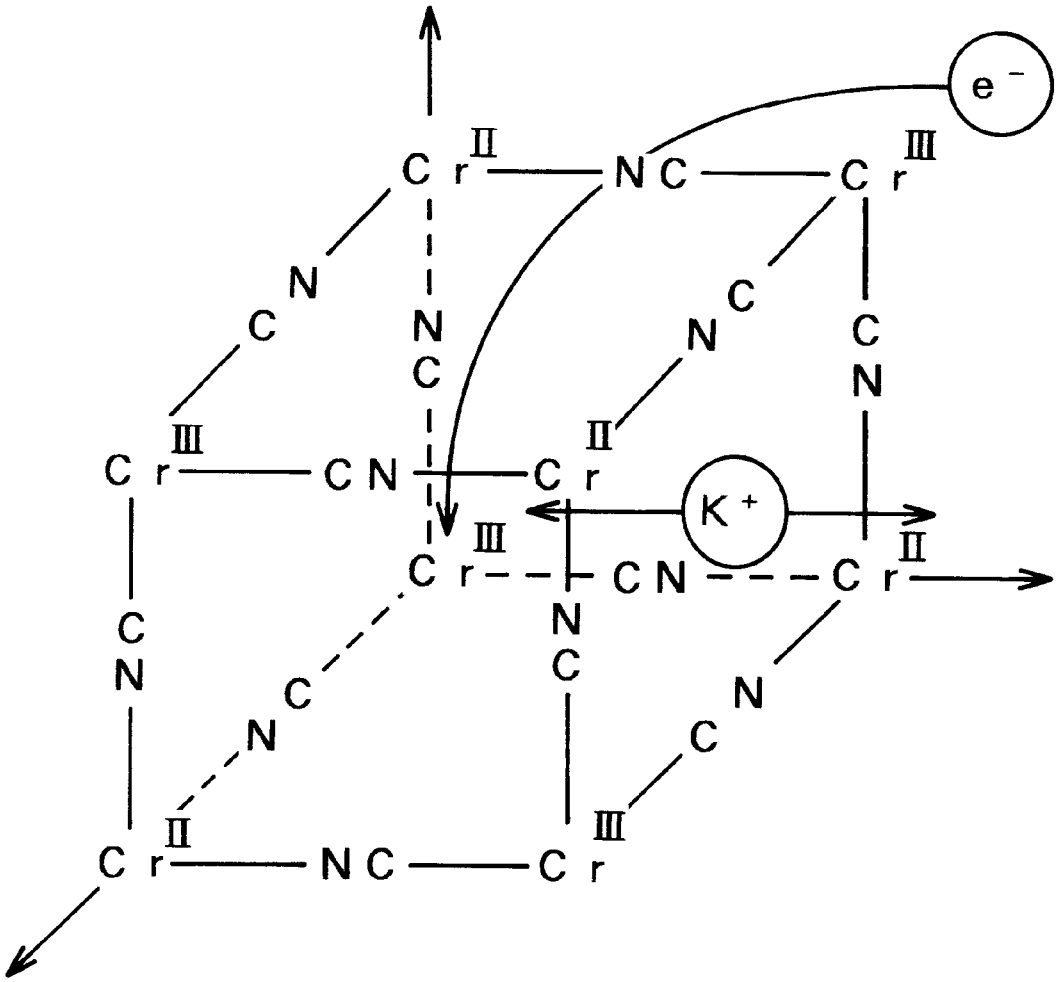
FIG. 7 is a descriptive view illustrating the reducing action of a sample.
Figure 8:
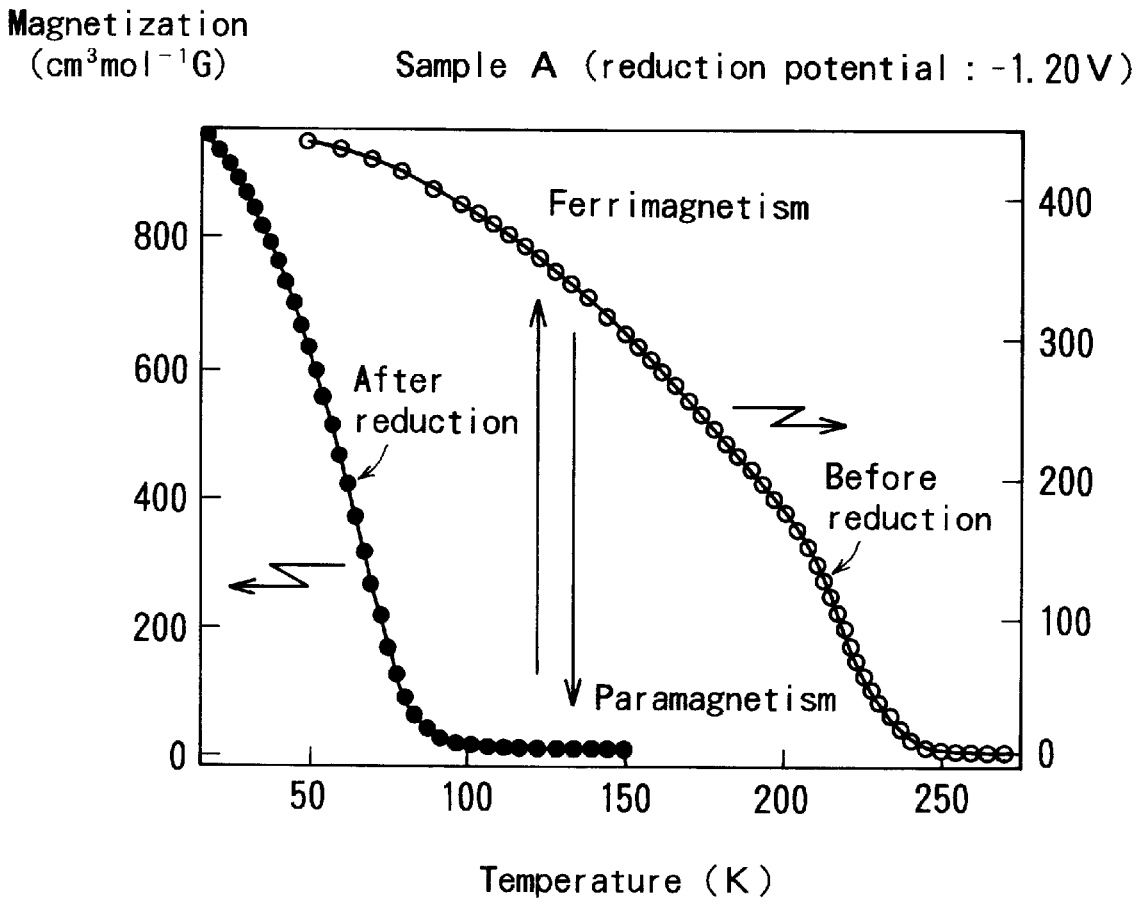
FIG. 8 is a graph illustrating temperature dependency of magnetization before and after reduction of the sample A with a reduction potential of −1.20 V.
Figure 9:
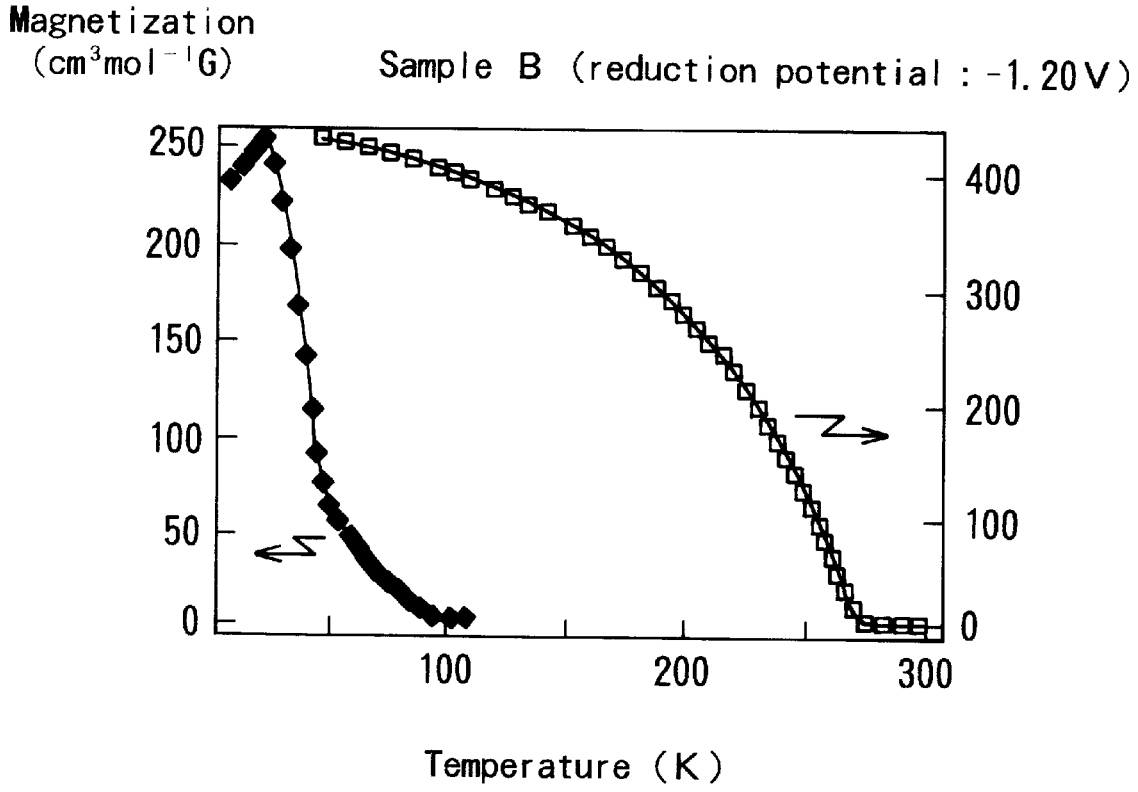
FIG. 9 is a graph illustrating temperature dependency of magnetization before and after reduction of the sample B with a reduction potential of −1.20 V.
Figure 10:
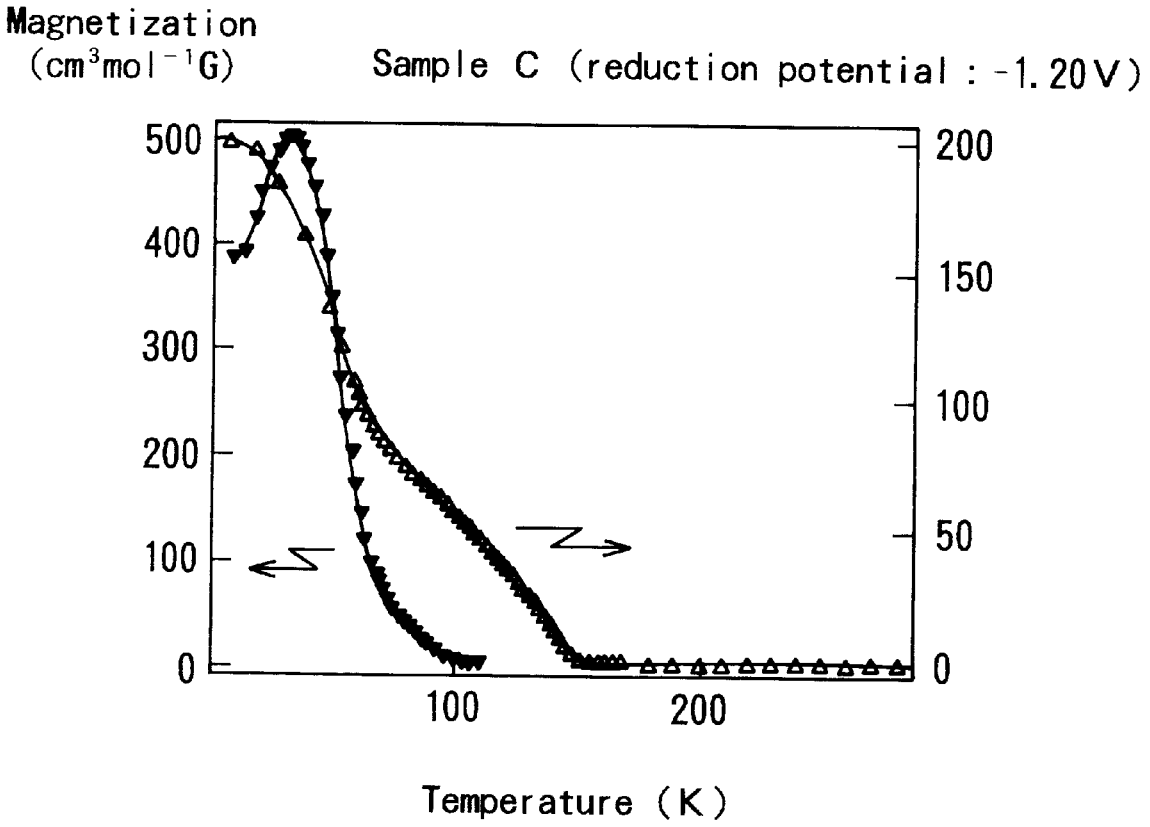
FIG. 10 is a graph illustrating temperature dependency of magnetization before and after reduction of the sample C with a reduction potential of −1.20 V.
Figure 11:
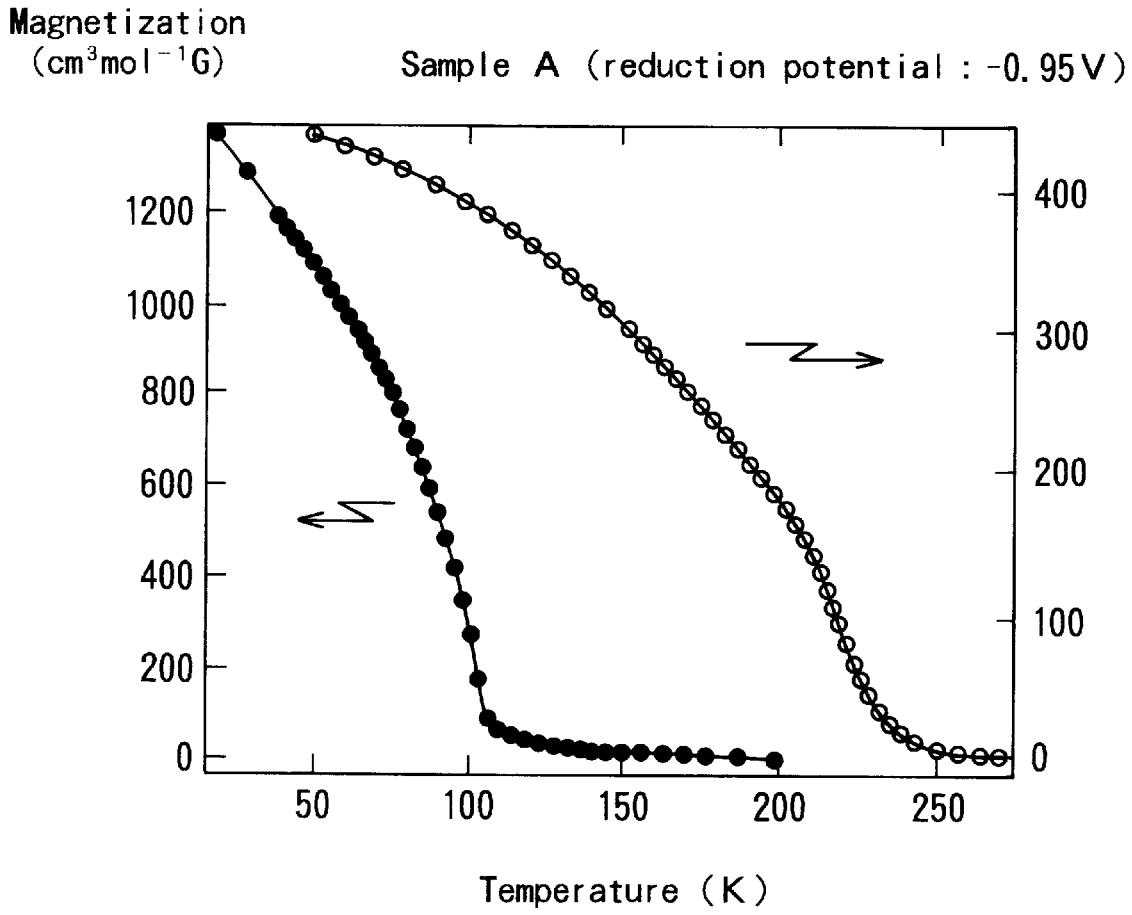
FIG. 11 is a graph illustrating temperature dependency of magnetization before and after reduction of the sample A with a reduction potential of −0.95 V.
Figure 12:
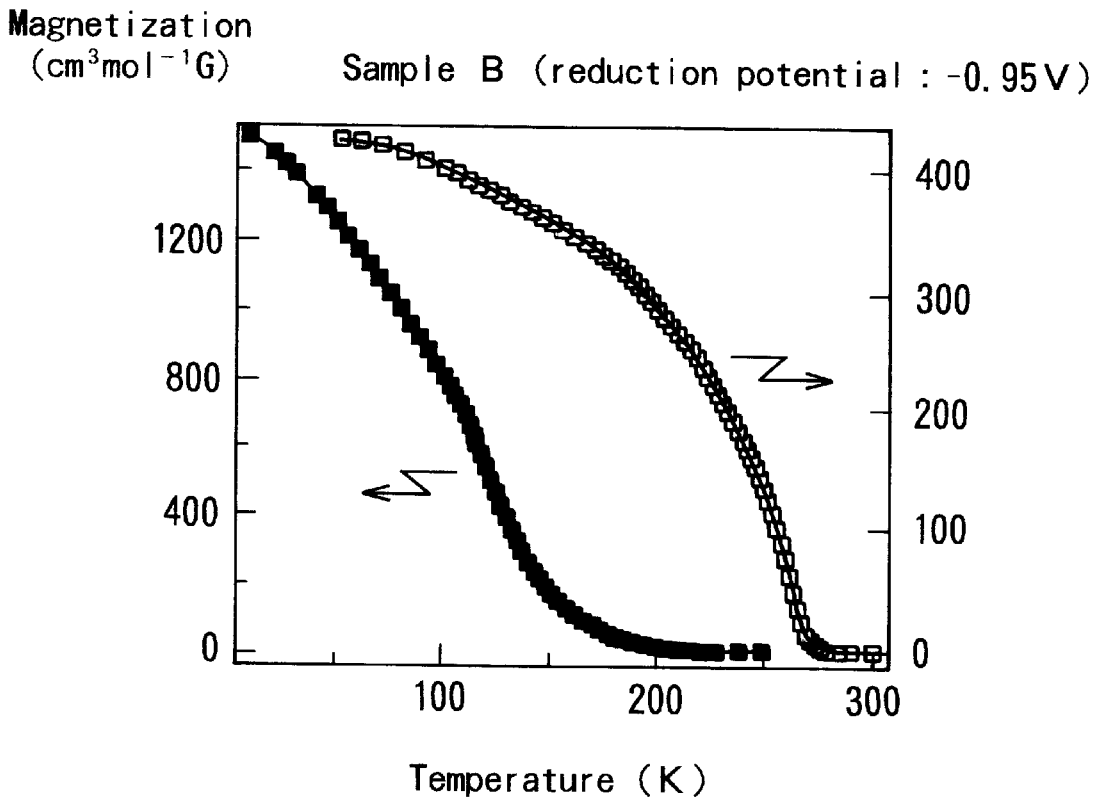
FIG. 12 is a graph illustrating temperature dependency of magnetization before and after reduction of the sample B with a reduction potential of −0.95 V.

For any of the samples A, B and C, it is possible to cause reversible reactions of electrochemically reducing $Cr^{III}$ into $Cr^{II}$ and on the contrary oxidizing $Cr^{II}$ into $Cr^{III}$ by controlling the potential impressed onto the sample while bringing the sample into contact with a liquid or solid electrolyte, because of the zeolite-like properties thereof, and epoch-making findings were obtained that this permits a large change in the magnetic transition temperature. Along with this electrochemical reduction or oxidation cations in the solution capable of entering into interstitial gaps are reversibly doped and dedoped FIG. 7 is a descriptive view of the reducing action of samples, and FIG. 8 is a graph illustrating temperature dependency of magnetization before and after reduction of the sample A with a reducing potential of −1.20 V. As is clear from FIG. 8, the magnetic transition temperature of 240 K before reduction, decreases to 80 K after reduction. This suggests an epoch-making fact that the state between ferrimagnetic and paramagnetic states can be electrochemically controlled between 80 K and 240 K, FIGS. 9 and 10 are graphs illustrating temperature dependency of magnetization before and after reduction of the samples B and C with a reduction potential of −1.20 V, respectively. FIGS. 11 and 12 are graphs illustrating temperature dependency of magnetization before and after reduction of the samples A and B with a reduction potential of −0.95 V.

In all the foregoing cases, the reduction potential represents a value measured with a saturated calomel electrode as a reference electrode.

These results demonstrate an epoch-making fact that it is possible to set a control between ferrimagnetic and paramagnetic states to a desired relationship by altering the reduction potential. It is also epoch-making that the aforesaid reduction/oxidation reactions can be accomplished by a very simple operation of controlling the sample potential while bringing the sample into contact with a liquid or solid electrolyte.

By utilizing this property, therefore, the present invention has an epoch-making applicability to an extent of proposing novel technical fields so far non-existent such as application to write or erase into or from a record, application magnetic/mechanical machines, magnetic shield, electromagnetic wave absorbing materials, audio devices such as a loudspeaker and a microphone, switches and sensors.

The above example has covered a case in which the ion present in the electrolyte is $Cs^+$ ion. This ion may, however, be any one or more selected from the group consisting of, as described above, other alkali metal ion, alkali earth metal ion, rare earth metal ion, and ammonium ion, such as $K^+$, $Rb^+$, $Na^+$, $NH_4^+$. $Mg^{2+}$, $Eu^{3+}$ and $N(C_2H_5)_4^+$ ions. The electrode, on the surface of which the cyanochromium-complex-based magnetic material is formed, may be, in addition to $SnO_2$ described above, Pt. ITO (indium-tin oxide), or any of various other conductive materials.

INDUSTRIAL APPLICABILITY

According to the invention, as described above in detail, there is provided a cyanochromium-complex-based magnetic material which had excellent magnetic properties including a high magnetic transition temperature and in which these magnetic properties are controllable in a reversibly variable manner through electrochemical oxidation and reduction. This is not only a proposal of a novel molecular magnetic thin-film material, but also an epoch-making achievement of quite a new idea of controlling magnetic properties.

As described above, this molecular magnetic thin-film material is applicable, not only to uses similar to those of the conventional magnetic materials, but also in a wide range of industrial fields including a new type memory switching, through effective utilization of the control of magnetic properties, a remarkable feature of the invention.

What is claimed is:

1. A cyanochromium-complex-based magnetic material, formed as a film on an electrode through electrochemical reduction of $Cr^{3+}$ into $Cr^{2+}$ in a solution containing $[Cr(CN)_6]^{3-}$ and $Cr^{3+}$, wherein magnetic properties of the material can be reversibly adjusted between paramagnetism and ferrimagnetism through electrochemical oxidation and reduction.

2. A cyanochromium-complex-based magnetic material of which magnetic properties are reversibly variable through electrochemical oxidation and reduction, wherein said magnetic properties are paramagnetism and ferrimagmetism.

3. A method of manufacturing a cyanochromium-complex-based magnetic material, formed as a film on an electrode, comprising placing an electrode into a solution containing $[Cr(CN)_6]^{3-}$ and $Cr^{3+}$ and electrochemically reducing $Cr^{3+}$ to $Cr^{2+}$, wherein the magnetic properties of the magnetic material can be reversibly adjusted between paramagnetism and ferrimagnetism through electrochemical oxidation and reduction.

4. The manufacturing method of a cyanochromium-complex-based magnetic material according to claim 3, which comprises the step of forming a film with different magnetic properties by altering electrolytic conditions.

5. The manufacturing method of a cyanochromium-complex-based magnetic material according to claim 4, wherein the electrolytic conditions are selected from the group consisting of reduction potential, electrolyte concentration, setting of a constant potential or a constant current, quantity of electricity and presence of a coexistent ion.

6. The manufacturing method of a cyanochromium-complex-based magnetic material according to claim 3, wherein the solution contains one or more ions selected from the group consisting of alkali metal ion, alkali earth metal ion, rare earth metal ion, and ammonium ion.

7. A magnetic film comprising a cyanochromium-complex-based magnetic material formed by electrochemical reduction of $Cr^{3+}$ into $Cr^{2+}$ in a solution containing $[Cr(CN)_6]^{3-}$ and $Cr^{3+}$, wherein the magnetic properties of the film can be reversibly adjusted between paramagnetism and ferrimagnetism through electrochemical oxidation and reduction.

8. A method of manufacturing the film according to claim 7, said method comprising placing an electrode in a solution containing $[Cr(CN)_6]^{3-}$ and $Cr^{3+}$, and electrochemically reducing $Cr^{3+}$ to $Cr^{2+}$.

9. The method of claim 8, further comprising altering the electrochemical conditions to form a film with different magnetic properties.

10. The method of claim 9, wherein the electrolytic conditions altered are selected from the group consisting of reduction potential, electrolyte concentration, setting of constant potential or constant current, quantity of electricity and the presence of a coexistence ion.

11. The method of claim 8, wherein the solution further contains one or more ions selected from the group consisting of an alkali metal ion, alkali earth metal ion, a rare earth metal ion and an ammonium ion.

* * * * *